United States Patent [19]

Wueger

[11] 4,108,216

[45] Aug. 22, 1978

[54] YARN DISPENSING APPARATUS FOR A LOOM AND THE METHOD THEREOF

[76] Inventor: Karl W. Wueger, Ward St., North Brookfield, Mass. 01535

[21] Appl. No.: 522,402

[22] Filed: Nov. 11, 1974

[51] Int. Cl.[2] ..... D03D 47/36

[52] U.S. Cl. ..... 139/452

[58] Field of Search ..... 139/122 R, 122 H, 127 P, 139/450, 452; 226/97, 117, 118; 242/55

[56] References Cited

U.S. PATENT DOCUMENTS

| | | | |
|---|---|---|---|
| 3,799,211 | 3/1974 | Klinecky et al. | 139/122 |
| 3,865,149 | 2/1975 | Keldany | 139/122 |
| 3,870,088 | 3/1975 | Scheffel | 139/122 |

*Primary Examiner*—Henry S. Jaudon
*Attorney, Agent, or Firm*—David G. Conlin

[57] ABSTRACT

Method of and apparatus for dispensing a weft yarn to an outside filling supply loom in which weft yarn is drawn from a supply package and fed into a spiral shaped conduit which has an opening at each end and a continuous opening connecting both end openings. An air flow is created in the conduit which is effective to draw a loop of said weft yarn into the conduit through one of the end openings thereof, said weft yarn being subsequently withdrawn from the continuous opening for insertion into the loom.

19 Claims, 6 Drawing Figures

YARN DISPENSING APPARATUS FOR A LOOM AND THE METHOD THEREOF

BACKGROUND OF THE INVENTION

This invention relates to shuttleless looms wherein weft yarn is drawn from a stationary supply source for insertion into the loom and is more particularly directed to means for drawing yarn from the supply source and dispensing it to the loom in a controlled manner.

Known dispensing devices include a measuring device which draws the weft yarn from a stationary supply source and winds it on a drum so that the number of loops on the drum determines the measured length. Thereafter, the yarn is taken off the measuring drum and propelled through the warp shed. Experience has shown that there is a certain amount of surface tension between the yarn loops and the drum which must be overcome. With ever increasing loop speeds, it is important that the yarn is drawn into the warp shed with as little resistance as possible.

Other dispensing devices store a length of weft yarn in the form of a loop. This loop may be formed by a light spring or by blowing or drawing the weft yarn into a chamber. The disadvantage of this approach is that in outside filling supply looms, speeds are of such magnitude that the enertial stress on the weft yarn is extreme. The forces required to overcome the spring which holds the loop of weft yarn or to accelerate the loop of weft yarn will interfere with insertion of the weft yarn into the loom or may even result in rupture of the weft yarn.

It is a principal object of the invention to provide a method of and apparatus for yarn dispensing with less resistance than any known type of yarn measuring and dispensing devices and with less enertial stress to the weft yarn than prior art storage devices.

SUMMARY OF THE INVENTION

The principal object of the invention is accomplished by feeding a loop of weft yarn into a storage magazine which comprises a conduit having an opening at each end and a continuous opening along one side of the conduit which extends from one end opening to the other. A valve is controlled so that it alternately seals and unseals the continuous opening. Means are provided for creating an air flow through the conduit when the continuous opening is sealed for drawing a loop length of filling into the conduit from a source of supply. When the continuous opening is unsealed, the yarn is free to be drawn therefrom into the loom with very little resistance. It is preferred that the conduit be spiral shaped for a more efficient use of space and that the dispensing means include a positive feed member located between the conduit and the source of supply for drawing yarn from the source of supply at the same rate as the being consumed by the loom. Another advantage of the spiral shape is that the loop will maintain its integrity even in the absence of the air flow. The fact that the loop is wound at least 360° prevents the loop from twisting upon itself due to the mutual twist of the yarn.

DETAILED DESCRIPTION OF THE INVENTION

Figure 1:
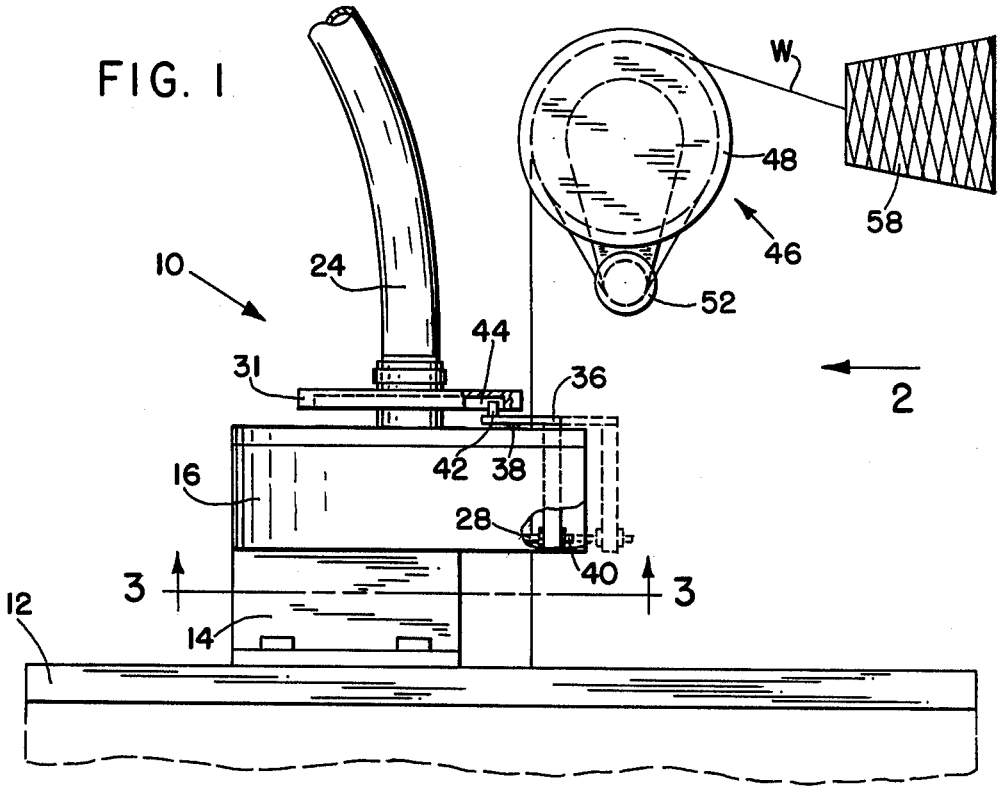
FIG. 1 is a plan view of a weft yarn dispensing apparatus as applied to a loom.
Figure 2:
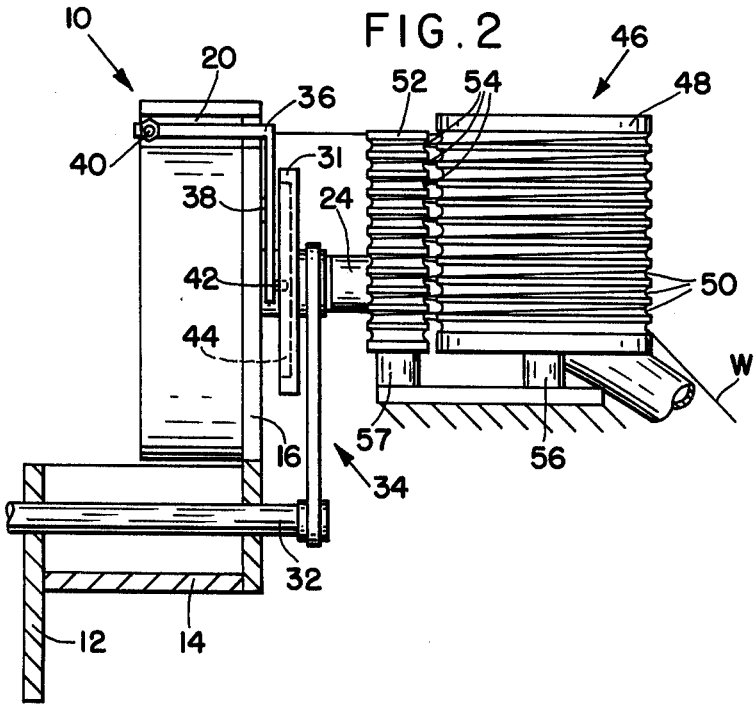
FIG. 2 is a side elevation of the invention, looking in the direction of arrow 2 in FIG. 1, with portions in section.

Referring particularly to FIG. 1 and 2, the yarn dispensing apparatus for the present invention is generally indicated by the reference numeral 10 and is shown attached to the frame 12 of a loom by a bracket 14. Only a portion of the loom frame is shown. The loom may be of any type in which weft is inserted from outside supply packages.

Figure 3:
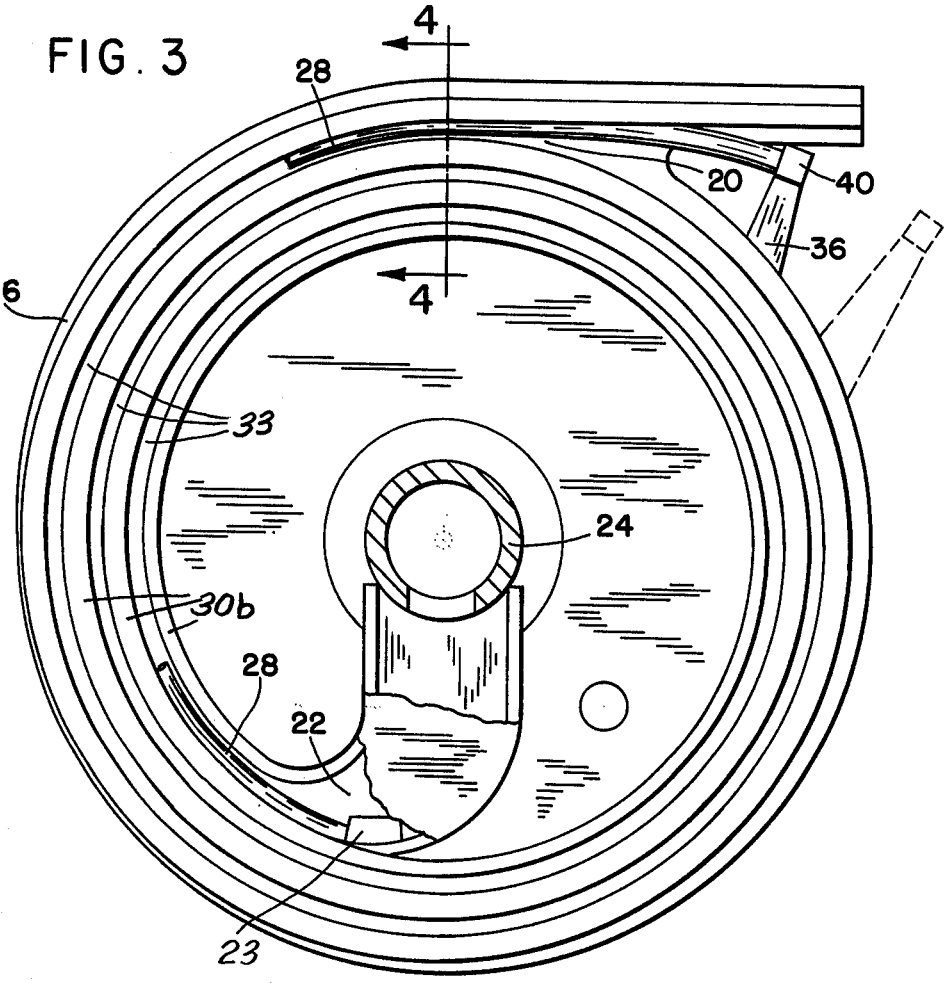
FIG. 3 is a vertical section taken on line 3—3 in FIG. 1 and looking in the direction of the arrows.
Figure 4:
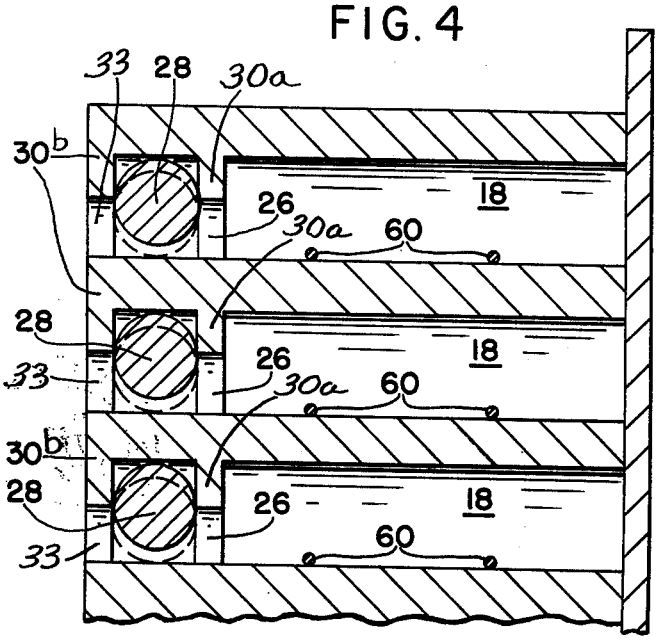
FIG. 4 is a vertical section, on an enlarged scale, taken along line 4—4 in FIG. 3, showing details of the conduit and the relationship between it and the valve.
Figure 5:
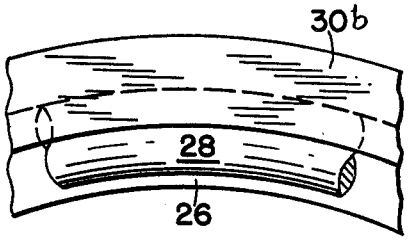
FIG. 5 is a fragmentary view, on an enlarged scale, of a portion of the conduit as viewed in FIG. 3, showing the valve in the open position.
Figure 6:
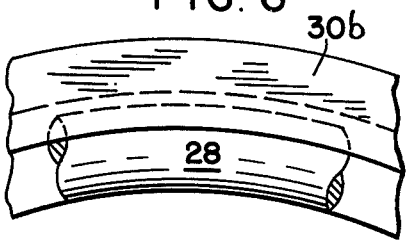
FIG. 6 is a view similar to FIG. 5, showing the valve in the closed position.

The yarn dispensing apparatus of the present invention comprises a housing 16 which contains a spiral conduit 18, see FIGS. 3 and 4. Conduit 18 has an opening 20 at its outer end and an opening 22 at its inner end. Opening 22 is pneumatically connected to a suction pipe 24. Conduit 18 also contains a continuous opening 26 which extends from opening 20 to opening 22. A valve 28 is located adjacent opening 26 along substantially the entire length of the opening and is anchored at 23. Valve 28 is a flexible push-pull member which is round in the cross-section, the diameter of which is larger than opening 26, so that when valve 28 occupies the position indicated in FIG. 6 and the dotted line position in FIG. 4, the opening 26 is effectively sealed. Suction pipe 24 draws air continuously so that when opening 26 is sealed, an air flow will be created from opening 20 to opening 22. When the valve 28 occupies the position shown in FIG. 5 and the full line position in FIG. 4, opening 26 is open to the atmosphere along its length. Inner and outer lips **30*a* and 30*b*, respectively, extend along the length of the conduit for retaining valve 28. Lip 30*b* forms an outer opening 33 outside of valve 28** and may be a continuous member as shown or may be a series of projections.

The control means for actuating valve 28 includes a cam 31 rotatably mounted on the housing 16 and driven by a shaft 32 through a belt and pulley drive indicated generally at 34. Shaft 32 is inoperably connected to the loom so that cam 31 is driven in timed relation to the loom. A bell-crank lever 36 is driven in timed relation to the loom. One end of lever 36 is pivotally attached at 38 to the housing. One end of lever 36 is connected at 40 to one end of valve 28. The other end of lever 36 is attached to a follower 42 which rides in a groove 44 in cam 31. Cam 31 is effective to shift the upper portion of lever 36 to the right to the dotted line position as viewed in FIG. 3 for shifting valve 28 to the closed position and to the left to the full line position for shifting valve 28 to the open position. When valve 28 is in the open position, opening 26 is unsealed as shown in full lines in FIG. 4 and when it is in closed position, opening 26 is sealed as shown in dotted lines in FIG. 4.

The weft yarn is supplied to dispensing apparatus 10 from a positive feed mechanism indicated generally at 46 and is an example of one of many types of positive feed mechanisms which may be used. Mechanism 46 includes a driven roll 48 with circumferential parallel grooves 50 and an idler roll 52 with circumferential parallel grooves 54. Roll 48 is rotatably driven by a shaft 56 in timed relation with the loom drive. Idler roll 52 is mounted for free rotation on a shaft 57. The weft yarn, indicated at W, extends from a supply package 58 to one of the grooves 50 which is at one end of roll 48 and then to the endmost groove 54 on idler roll 52. Grooves 54 and 50 are offset with respect to each other so that the yarn progresses from the end groove at one end of roll 48 to the groove at the opposite end thereof and then extends to the dispensing apparatus 10. By selecting the correct diameter of grooves 50, together with the fact that the rotation of shaft 56 is synchronized with the loom drive, yarn is drawn from package 58 at the same rate that yarn is consumed by the loom for any loop speed.

Groove 44 of cam 31 is designed so that during operation of the loom, valve 28 is closed during the time that weft yarn is not being inserted into the warp shed. Since suction pipe 24 draws air from opening 22 continously, the resulting air flow from end 20 to end 22 causes a loop of yarn to be drawn into conduit 18 from positive feed mechanism 46. The loop of yarn, indicated at 60, will follow the spiral contour of conduit 18 and the amount of yarn made available by the feed mechanism 46 will determine how far the loop of yarn will extend along the conduit. Prior to weft insertion, valve 28 will be shifted to its open position which will occur progressively from end opening 20 to end opening 22. One side of the weft loop will be pulled out of openings 26 and 33 beginning at the outer end of the spiral and drawn progressively down to the end of the loop in the inner portion of the spiral. The other side of the loop will then be pulled through openings 26 and 33 from the inner portion of the spiral progressively to the outer portion thereof. Although the actual dispensing of the weft yarn from conduit 18 takes place in a fraction of a second, only a small portion of the entire loop of yarn is affected at any one instant, since it is drawn progressively. The inertial resistance of the yarn is therefor reduced. During the brief period when yarn is withdrawn from spiral conduit 18, a small amount of additional yarn is made available from feed mechanism 46. This additional amount is also incorporated as part of that particular weft insertion.

It is contemplated that the conduit could be formed into other curved shapes but it is believed the spiral shape represents the most efficient form.

I claim:

1. A yarn dispensing apparatus for a loom comprising:

(a) a conduit having an opening at each end thereof and a continuous opening which extends from one of said end openings to the other along one side of said conduit;

(b) a valve for sealing said continuous opening;

(c) means for creating an air flow through said conduit from one of said end openings to the other upon sealing of said continuous opening to draw a loop of yarn from a source of supply into said conduit through said one end opening; and (d) control means for actuating said valve so that said continuous opening is alternately unsealed to allow said yarn to be withdrawn from said conduit through said continuous opening to said loom and sealed to allow an additional length of said yarn to be drawn into said conduit from said source of supply.

2. The yarn dispensing apparatus as set forth in claim 1 wherein said valve is effective to unseal said continuous opening progressively from the end opening through said one end opening.

3. The yarn dispensing apparatus as set forth in claim 1 wherein said conduit is curved.

4. The yarn dispensing apparatus as set forth in claim 2 wherein said curved conduit is spiral shaped.

5. The yarn dispensing apparatus as described in claim 3 wherein said valve comprises a flexible push-pull member, one end of which is anchored with respect to said conduit at said other end opening, said member being disposed in cooperating position with respect to said continuous opening so that movement in one direction of the other end of said push-pull member will cause said member to seal said continuous opening and movement of said other end in the opposite direction will cause said member to unseal said continuous opening.

6. The yarn dispensing apparatus as set forth in claim 5 wherein said control means comprises:

(a) a cam; and (b) a follower mounted for engagement with said cam and operatively connected to said other push-pull cable end.

7. The yarn dispensing apparatus as set forth in claim 1 wherein said means for creating an air flow through said conduit comprises a suction device for creating a sub-atmospheric pressure at said other end opening.

8. The yarn dispensing apparatus as set forth in claim 1 comprising a positive feed mechanism located between said conduit and said source of supply for drawing yarn from said source of supply at a predetermined rate.

9. A yarn dispensing apparatus for a loom comprising:

(a) a spiral shaped conduit having an inlet opening at one end thereof and a continuous opening which extends from said inlet opening along the length of said conduit;

(b) means for retaining the end of a weft yarn extending from a supply package;

(c) means for creating an air flow in said conduit which is effective to draw a loop of said weft yarn into the conduit in a spiral, whereby said loop will be withdrawn from said conduit axially of said spiral through said continuous opening to a loom.

10. The yarn dispensing apparatus as set forth in claim 9 comprising a positive feed mechanism located between said conduit and said supply package for drawing weft yarn from said supply package at a predetermined rate.

11. The yarn dispensing apparatus as set forth in claim 9 comprising a valve and controls therefor for alternately sealing and unsealing said continuous opening coincident with drawing said loop of weft yarn into said conduit and withdrawing it therefrom, respectively.

12. A method of dispensing a weft yarn from a supply package for insertion into an outside filling supply loom by storing a length of weft yarn sufficient for one pick in a magazine, which method comprises:

(a) feeding a loop of weft yarn into a storage magazine from a supply package;

(b) creating a spiral air flow within said magazine which directs the loop of weft into a spiral; and (c) withdrawing from said magazine, one leg of said loop progressively from one end of said spiral to the other and then the other leg of said loop from said other end to said one end of said spiral.

13. The method of dispensing a weft yarn from a supply package as set forth in claim 12 wherein said weft yarn is positively fed from said supply package to the storage magazine at a uniform and continuous rate.

14. A yarn dispensing apparatus for a loom comprising:

(a) an elongated conduit having an inlet opening at one end thereof, an outlet opening adjacent the opposite end thereof and a continuous opening which extends along the length of said conduit;

(b) means for retaining the end of a weft yarn extending from a supply package;

(c) means for creating an air flow in said conduit and for drawing said weft yarn into said conduit;

(d) means for selectively obstructing at least a portion of said continuous opening;

(e) control means for actuating said obstructing means so that said continuous opening is alternately obstructed to allow said weft yarn to be drawn by said air flow into said conduit in the form of a loop and unobstructed to allow said weft yarn to be withdrawn from said conduit through said continuous slot.

15. The yarn dispensing apparatus as set forth in claim 14 wherein the means for selectively obstructing said continuous opening comprises means for sealing said continuous opening.

16. The yarn dispensing apparatus as set forth in claim 14 wherein said conduit is arcuate.

17. The loom dispensing apparatus as set forth in claim 14 wherein said conduit is spiral shaped.

18. A method of dispensing a weft yarn from a supply package for insertion into an outside filling supply loom by storing a length of weft yarn sufficient for one pick in; an elongated conduit having an inlet opening at one end and a continuous opening which extends from said inlet opening along the length of said conduit, which method comprises:

(a) retaining the end of said weft yarn so that it extends from said supply package at a point adjacent to said inlet opening;

(b) creating an air flow in said conduit from said inlet opening;

(c) blocking at least a portion of said continuous opening adjacent said inlet end so that said weft yarn will be drawn into said conduit by said air flow in the form of a loop;

(d) unblocking said continuous opening;

(e) withdrawing one leg of said loop progressively from the inlet end of said conduit toward the opposite end thereof; and (f) withdrawing the other leg of said loop progressively from said opposite end toward said inlet end.

19. The method of dispensing a weft yarn from a supply package as set forth in claim 17 wherein the steps of blocking and unblocking said continuous opening comprise sealing and unsealing, respectively, said continuous opening.

* * * * *